United States Patent [19]

Fisch

[11] Patent Number: 5,035,134

[45] Date of Patent: Jul. 30, 1991

[54] INDEXING CONVEYOR FOR A TRANSFER DIE SYSTEM

[75] Inventor: Alfred C. Fisch, Clarkston, Mich.

[73] Assignee: Rapindex Incorporated, Waterford, Mich.

[21] Appl. No.: 432,076

[22] Filed: Nov. 6, 1989

[51] Int. Cl.[5] ..... B21D 43/12

[52] U.S. Cl. ..... 72/405; 72/422; 198/803.9; 198/817

[58] Field of Search ..... 72/405, 422, 421; 198/803.9, 817, 470.1; 414/751

[56] References Cited

U.S. PATENT DOCUMENTS

| | | | |
|---|---|---|---|
| 2,295,852 | 9/1942 | LeJeune | 72/405 |
| 3,131,457 | 5/1964 | Correll | 72/405 |
| 3,229,739 | 1/1966 | Ellis | 198/803.9 |
| 4,874,081 | 10/1989 | Kondo | 198/803.9 |

FOREIGN PATENT DOCUMENTS

| | | | |
|---|---|---|---|
| 1261377 | 2/1968 | Fed. Rep. of Germany | 72/422 |
| 1801689 | 9/1970 | Fed. Rep. of Germany | 72/422 |
| 121276 | 10/1978 | Japan | 72/422 |
| 119428 | 7/1983 | Japan | 72/405 |

*Primary Examiner*—Daniel C. Crane

*Attorney, Agent, or Firm*—Barnes, Kisselle, Raisch, Choate, Whittemore & Hulbert

[57] ABSTRACT

A transfer die system that includes a fixed lower die, an upper die carried for reciprocal vertical movement toward and away from the lower die to perform operations on workpieces positioned between the dies, and a conveyor for feeding workpieces in sequence between the upper and lower dies. The upper and lower dies define a plurality of die stations, including a workpiece load station at the upstream end of the conveyor, a workpiece unload station at the downstream end of the conveyor, and at least one intermediate station for performing a desired operation on workpieces passing through the die. An improved conveyor that characterizes the present invention comprises an endless loop conveyor that has a reach vertically positioned between the upper and lower dies. A plurality of hands are carried by the conveyor at positions spaced from each other lengthwise of the conveyor by a distance corresponding to separation between the die stations, such that at least one hand is positioned to engage the workpiece at each of the stations. A drive is coupled to the conveyor for indexing the conveyor and workpieces between the upper and lower dies.

35 Claims, 7 Drawing Sheets

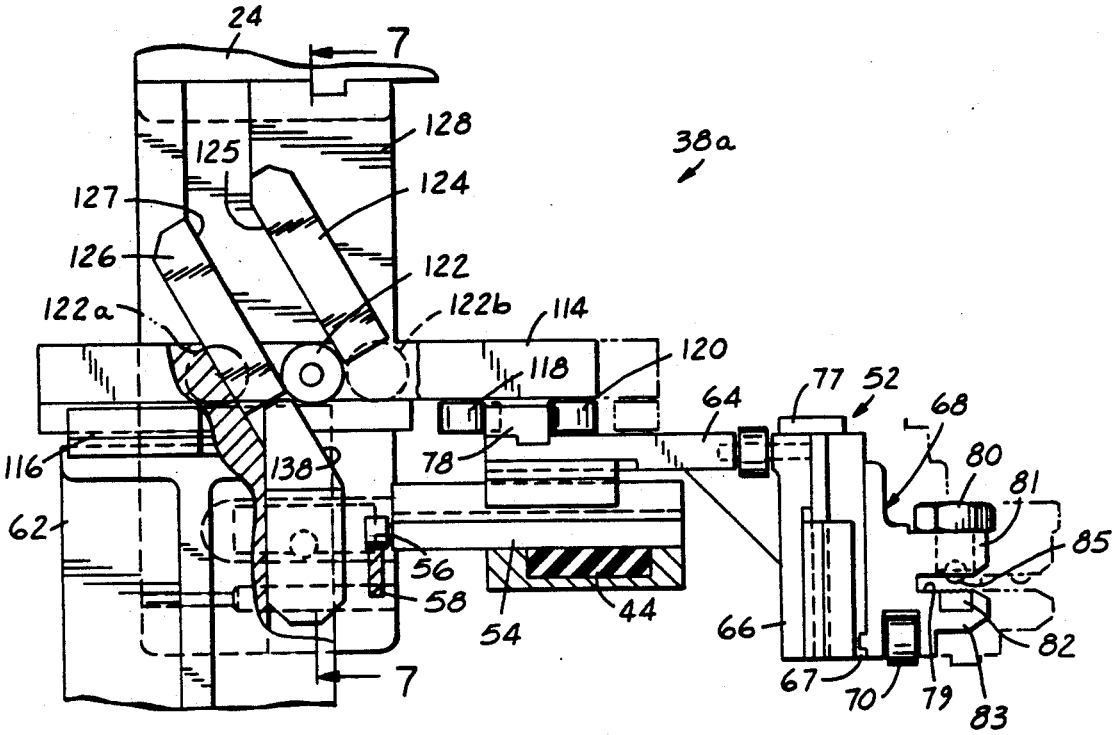
FIG.6
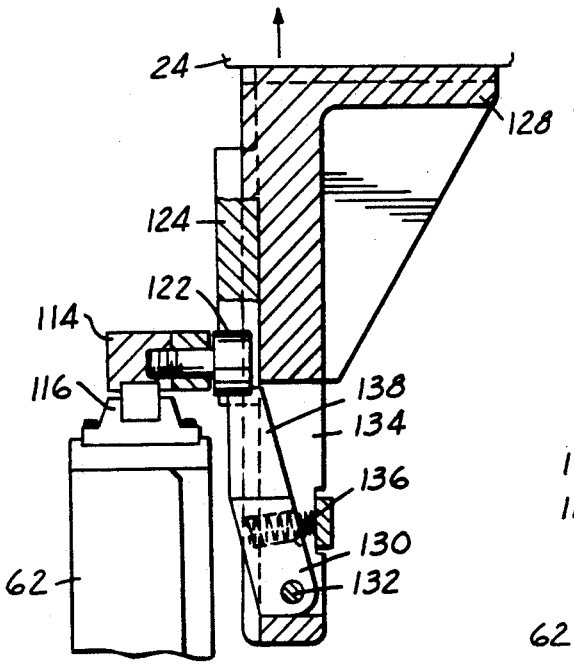
FIG.7
FIG.8
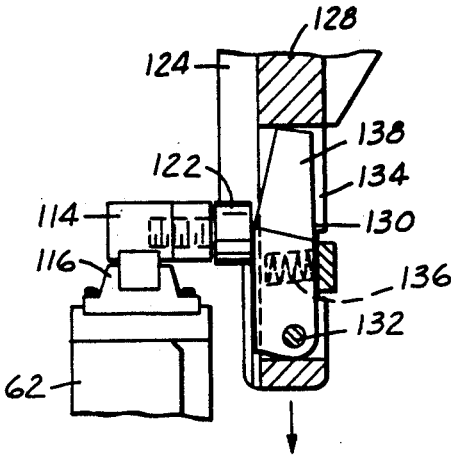

INDEXING CONVEYOR FOR A TRANSFER DIE SYSTEM

The present invention is directed to transfer die systems, and more particularly to an improved conveyor for indexing workpieces through the successive stations of the die assembly.

BACKGROUND AND OBJECTS OF THE INVENTION

In so-called progressive die systems, workpieces formed from strip stock remain attached to webs that extend along lateral edges of the pieces to facilitate indexing of the workpieces through the sequential stations of the die assembly. While such arrangements facilitate conveyance of the workpieces through the die stations, they possess the disadvantage that the workpieces must be formed in a linear array at space locations along the strip stock, leading to substantial material inefficiency and waste. Furthermore, the fact that all workpieces remain interconnected during at least a major portion of the die operation can lead to difficulty and inefficiency in performing operations on the workpieces at a given station. For these reasons and others, so-called transfer die systems have been developed in which the workpieces are pre-separated and fed as individual units to the die arrangement. A transfer die system of this character permits more efficient use of the strip stock material, and also permits greater flexibility in operations that can be performed at the individual die stations. However, the conveyor arrangement for indexing individual workpieces through a transfer die system is more complex than those in typical progressive die systems, usually involving release and re-engagement with the workpieces at each of the individual die stations.

A general object of the present invention, therefore, is to provide a transfer die system of the described character that features an improved conveyor for indexing workpieces sequentially through the individual die stations. Another and more specific object of the present invention is to provide a transfer die system in which the workpiece conveyor is of simplified construction that moves unidirectionaly through the die system, in which workpieces are automatically loaded onto and/or unloaded from the conveyor by movement of the die press, in which the conveyor retains engagement with the workpieces while operations are performed on the workpieces at the die working stations, and/or that may be readily modified for use in conjunction with sheet workpieces of differing geometries and configurations.

SUMMARY OF THE INVENTION

A transfer die system in accordance with the present invention includes a lower die, which typically would be mounted in fixed position, an upper die carried for reciprocal vertical movement toward and away from the lower die to perform operations on workpieces positioned between the dies, and a conveyor for feeding workpieces in sequence between the upper and lower dies. The upper and lower dies define a plurality of die stations, including a workpiece load station at the upstream end of the conveyor, a workpiece unload station at the downstream end of the conveyor, and at least one intermediate station for performing a desired operation on workpieces passing through the die. Such operation may include blanking, bending, piercing or any other typical workpiece forming operation, and does not per se form part of the present invention. The improved conveyor that characterizes the present invention comprises an endless loop conveyor that has a reach vertically positioned between the upper and lower dies. A plurality of hands are carried by the conveyor at positions spaced from each other lengthwise of the conveyor by a distance corresponding to separation between the die stations, such that at least one hand is positioned to engage the workpiece at each of the stations. A drive is coupled to the conveyor for indexing the conveyor and workpieces between the upper and lower dies.

The conveyor hands are carried for movement laterally inwardly and outwardly of the conveyor with respect to the longitudinal dimension of the die system. At the upstream end of the conveyor, the hands are initially positioned laterally outwardly of the die system, and the load station includes structure engaged by the upper die and responsive to downward motion of the upper die toward the lower die, for moving the hands laterally inwardly to engage and locate a workpiece. Likewise, at the downstream end of the conveyor, the unload station includes structure responsive to downward motion of the upper die for retracting the hands laterally outwardly, and thereby releasing workpieces engaged by the hands for subsequent processing or storage as desired. The hands also include facility for vertical motion. Normally, the hands carry the workpieces above the operating surfaces of the lower die, being supported by rollers on the hands that engage a rail extending along the conveyor path. At the operating station or stations of the die system, the rail is interrupted so that downward motion of the upper die engages a workpiece cushion that supports the workpiece and propels the workpiece downwardly toward the operating surface of the lower die.

Several embodiments of the workpiece hand are disclosed in the present application. In one embodiment, the periphery of the workpiece is laterally engaged and located by the hand, but not positively gripped by the hand. Other embodiments of the hand include spring-biased structure for positively clamping the periphery of the workpiece upon engagement of the hand with the workpiece. Preferably, the hands remain in gripping engagement with the peripheries of the workpieces as the workpieces are conveyed through sequential die work stations and operations are performed on the individual workpieces. However, one of the hand constructions in accordance with the present invention includes structure responsive to downward motion of the upper die assembly for releasing the workpiece at a die operating station, and to upward motion of the upper die assembly following the forming operation for regripping the workpiece periphery, either at the same lateral position or laterally inwardly from the previous gripping position. In this way, operations can be performed on the workpiece adjacent to the periphery without interference from the conveyor hands. Another embodiment of the hand includes structure responsive to the upper die assembly for rotating the workpiece about an axis lateral to the conveyor direction so that the dies may operate on the workpiece at an angle to the plane of the workpiece edge.

In the preferred embodiment of the invention, the conveyor takes the form of a pair of mirror-image endless loop conveyors positioned at laterally opposed sides of the lower die and carrying hands positioned in laterally opposed pairs. The loops are vertically oriented and have a common drive shaft positioned at one end of the conveyor. The drive shaft is coupled to a geneva drive mechanism that is responsive to upward motion of the upper die assembly for indexing the conveyor in equal increments through the die system. Thus, in the preferred embodiment of the invention, all conveyor motions are initiated by and responsive to downward and upward reciprocation of the upper die.

BRIEF DESCRIPTION OF THE DRAWINGS

The invention, together with additional objects, features and advantages thereof, will be best understood from the following description, the appended claims and the accompanying drawings in which:

FIG. 6 is a fragmentary sectional view similar to a portion of FIG. 3 but illustrating a modified conveyor construction;

FIG. 7 is a fragmentary sectional view taken substantially along the line 7—7 in FIG. 6;

FIG. 8 is a fragmentary view of a portion of FIG. 7 at an intermediate stage of operation;

DETAILED DESCRIPTION OF PREFERRED EMBODIMENTS

Figure 1:
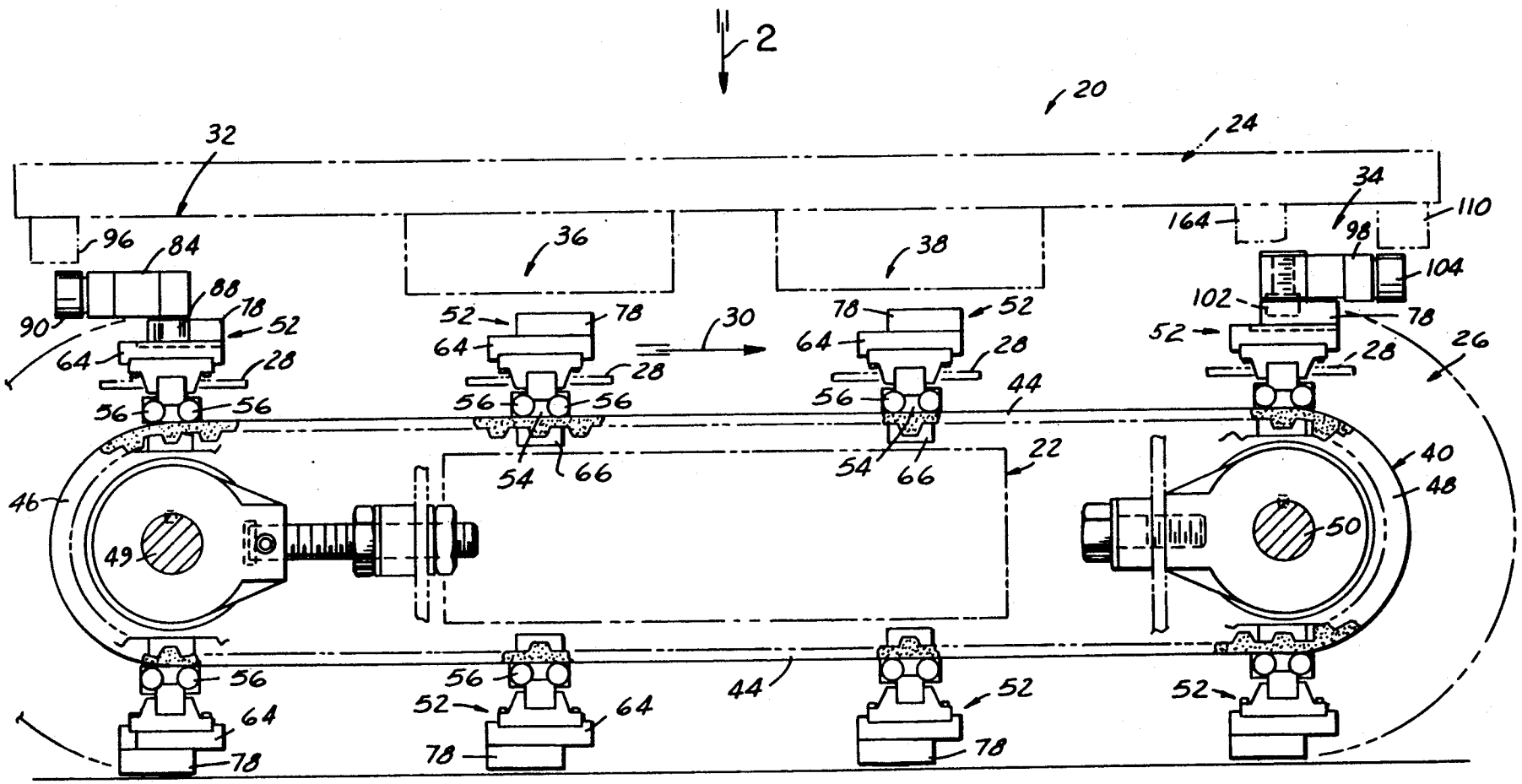
FIG. 1 is a side elevational view of a transfer die system in accordance with a presently preferred embodiment of the invention.
Figure 2:
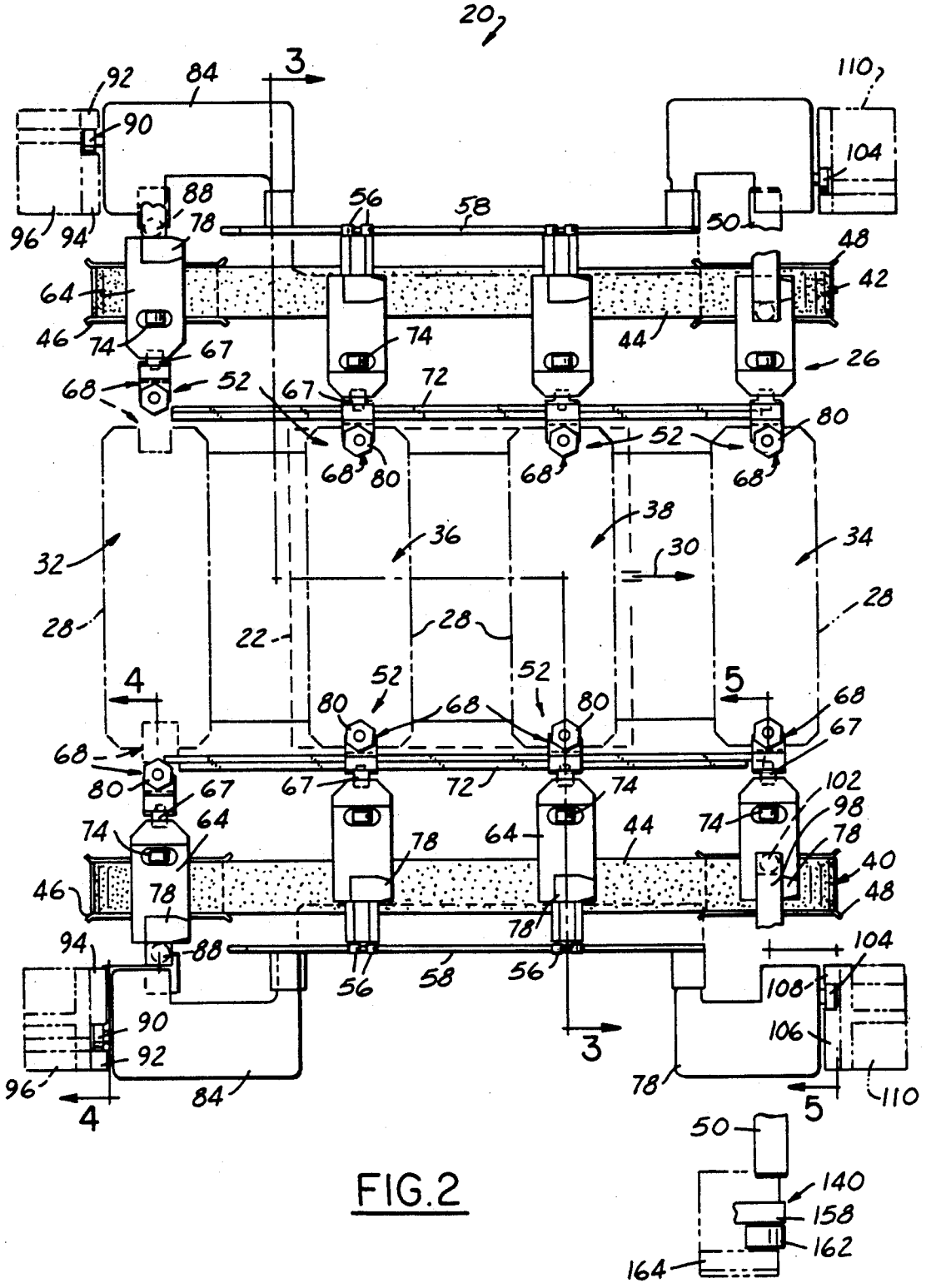
FIG. 2 is a top plan view of the transfer die system taken substantially from direction 2 in FIG. 1.

FIGS. 1 and 2 illustrate a transfer die system 20 in accordance with a presently preferred embodiment of the invention as comprising a fixed lower die 22 and an upper die 24 carried for reciprocal vertical movement toward and away from lower die 22 under control of a die press ram (not shown). A conveyor 26 feeds workpieces 28 in sequence through die system 20 in direction 30. The particular die system 20 illustrated in the drawings includes a workpiece load station 32 (FIGS. 1–2 and 4) at the upstream end of conveyor 26 for loading workpieces in turn onto the conveyor, a workpiece unload station 34 (FIGS. 1–2 and 5) at the downstream end of conveyor 26 for unloading workpieces from the conveyor for subsequent manufacturing operations or storage, and a pair of work stations 36,38 (FIGS. 1–3) between load station 32 and unload station 34 for performing desired forming operations on the workpieces conveyed therethrough. It will be appreciated, of course, that a greater or lesser number of work stations may be provided, and indeed an important feature of the present invention is that the transfer die system and conveyor may be extended lengthwise to accommodate a multiplicity of work stations between the load and unload stations.

Figure 3:
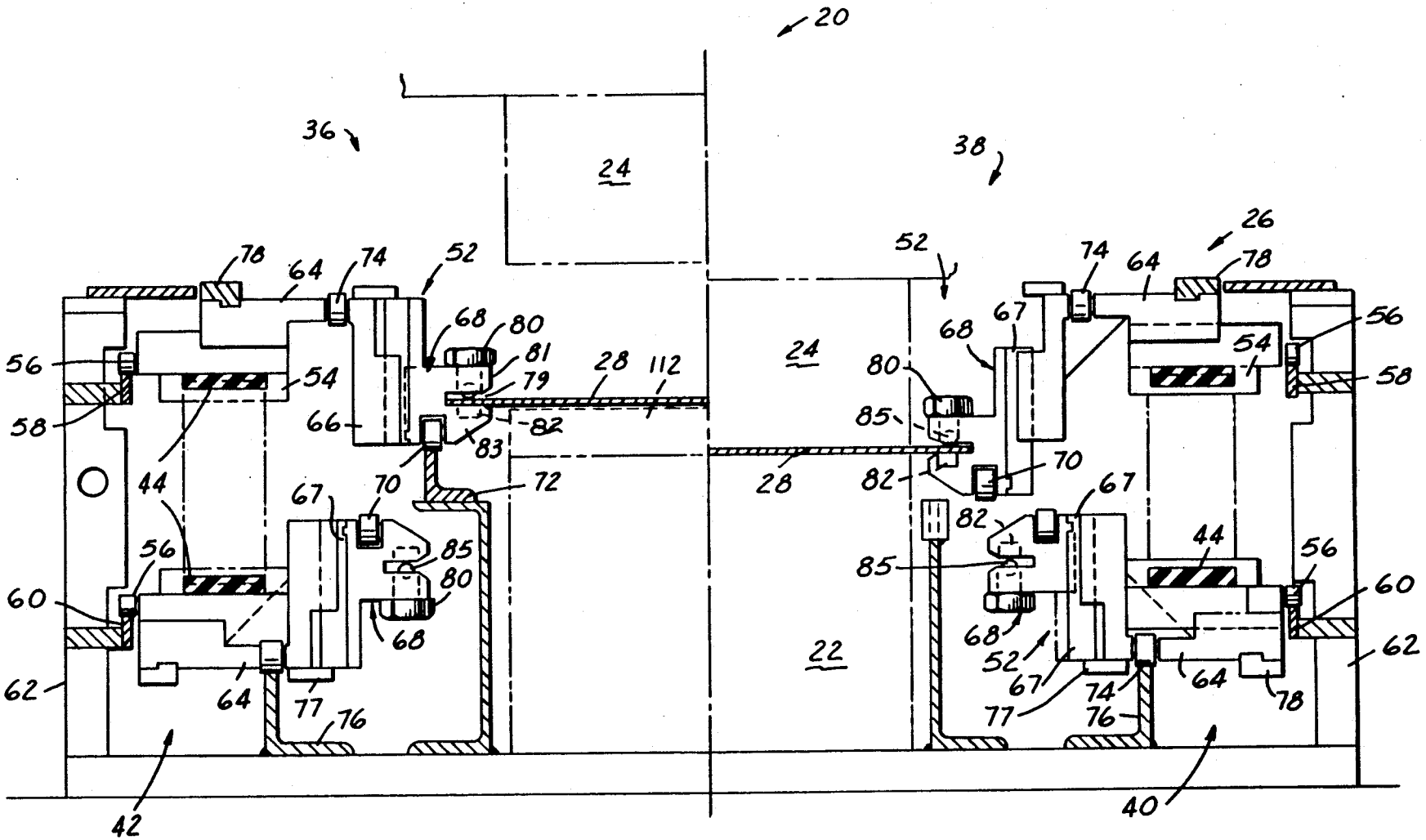
FIG. 3 is a sectional view taken substantially along the line 3—3 in FIG. 2 and illustrating operation of the conveyor hands at the die work stations.
Figure 4:
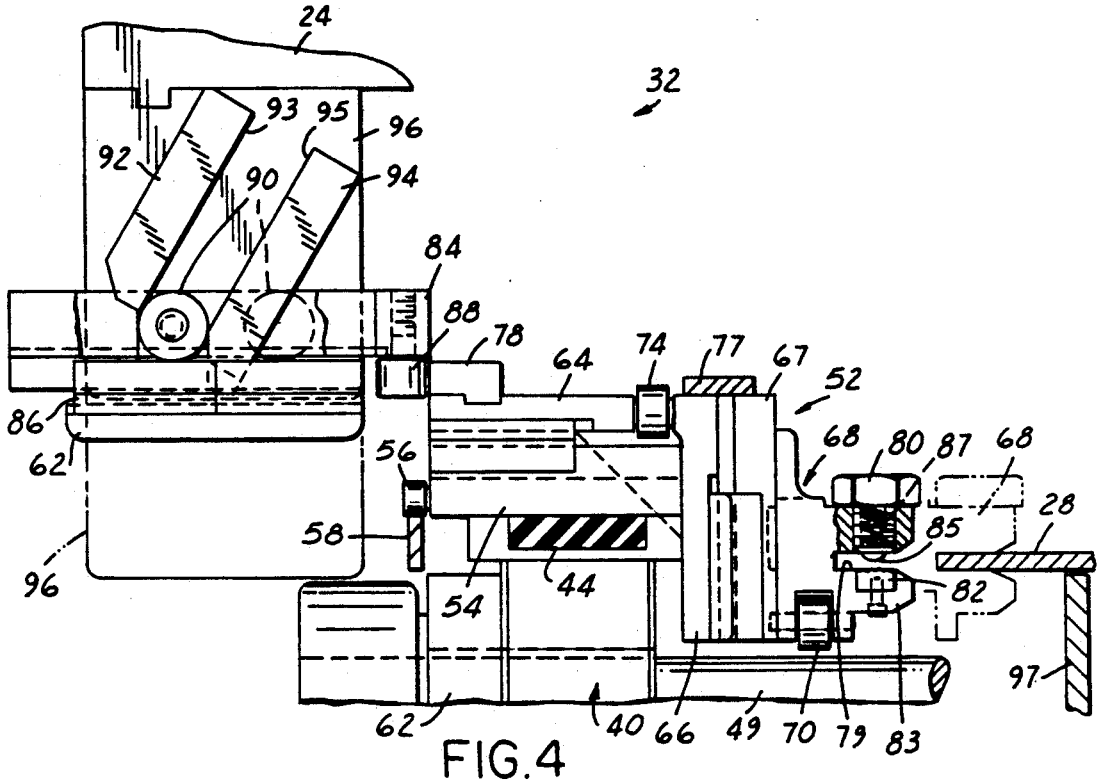
FIGS. 4 and 5 are fragmentary sectional views taken substantially along the lines 4—4 and 5—5 in FIG. 2, and respectively illustrating the load and unload stations of the workpiece conveyor.

Conveyor 26 comprises a pair of endless-loop belt conveyors 40,42 positioned at opposed lateral sides of fixed lower die 22. Conveyors 40,42 are mirror images of each other. (Directional adjectives such as "lateral" and "inner" are taken with respect to the central longitudinal axis of system 20.) The belts 44 of conveyors 40,42 are trained around a pair of sprockets 46,48 spaced from each other longitudinally of die system 20. Sprockets 48 are coaxially interconnected by a drive shaft 50, while sprockets 46 are coaxially carried on conveyor frame 62 by an idler shaft 49 (FIG. 4). The upper horizontal reaches of belts 44 are coplaner with each other. As best seen in FIG. 1, the upper reaches of belts 44 are positioned between lower die 22 and upper die 24 (in the upper position of the latter) and, as best seen in FIGS. 2 and 3, spaced laterally outwardly of lower die 22. A plurality of hands 52 are affixed to each belt 44 at positions spaced from each other longitudinally of conveyor 26 by a distance corresponding to separation between stations 32–38 of die assembly 20. As best seen in FIG. 2, hands 52 of respective loop conveyors 40,42 are positioned in laterally opposed pairs. In the preferred embodiment of the invention, each workpiece 28 (FIG. 2) is engaged by one laterally opposed pair of hands 52, so that longitudinal separation of hands 52 around respective conveyors 40,42 equals separation between die stations 32–38, which are equal to each other.

Figure 5:
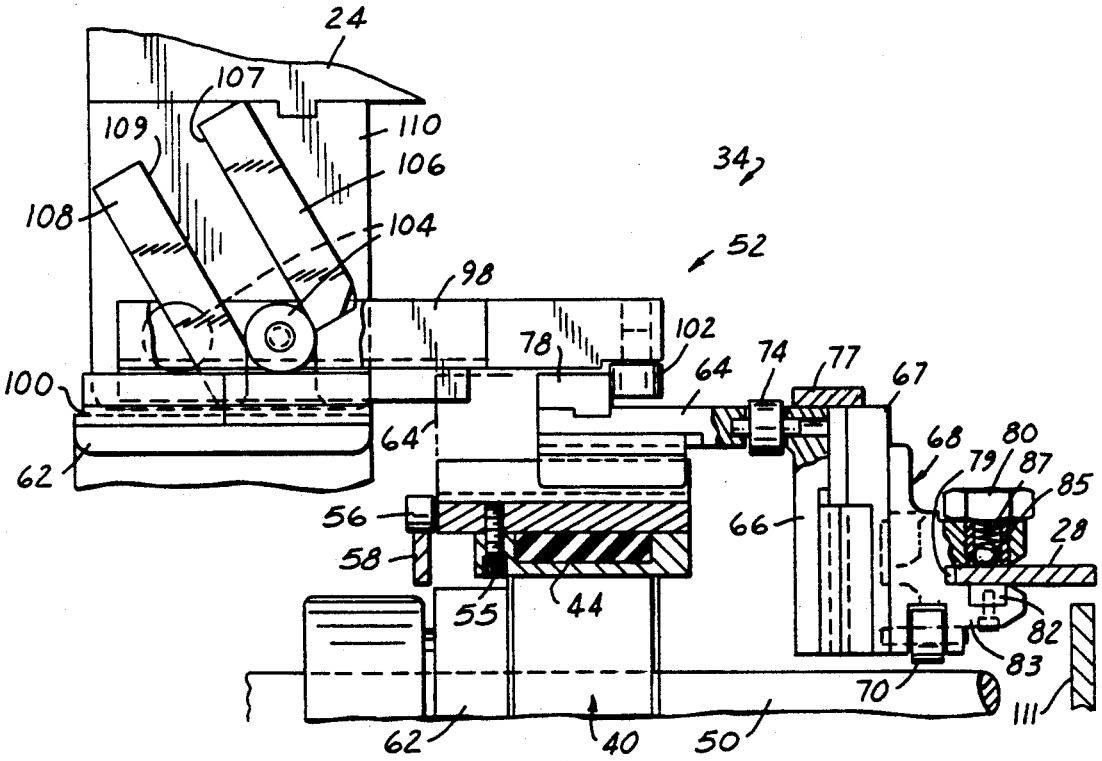

Referring to FIGS. 3–5, each hand 52 comprises a carrier 54 clamped by screws 55 to belt 44. A pair of rollers 56 (FIGS. 1 and 3–5) is mounted laterally outwardly of carrier 54 to engage and ride on a pair of rails 58,60 (FIGS. 2–5) mounted on the fixed conveyor frame 62 in the upper and lower reaches of belt 44 respectively. A finger mount 64 is supported on carrier 54 and is laterally slidable thereon between a retracted or laterally outer position illustrated in FIG. 4, and an extended or laterally inward position illustrated in FIGS. 3 and 5. Mount 64 is of generally L-shaped construction having a laterally inward downwardly extending portion 66 that carries a vertically slidable finger mount block 67. A finger 68 is removably affixed to each block 67. That is, finger 68 is carried by mount 64 for vertical sliding movement between an upper position illustrated in FIGS. 4–5 and on the left-hand side of FIG. 3, and a lower position illustrated on the right-hand side of FIG. 3 in which workpiece 28 engages the forming surface of lower die 22. Each finger 68 has a roller 70 at the lower edge thereof for engaging and riding along a rail 72 (FIGS. 2–3) that extends laterally adjacent to lower die 22 for holding fingers 68 in the upper position. A rollers 74 is also mounted on the upper portion of mount 64 for engaging and riding along a rail 76 (FIG. 3) carried by frame 62 in the lower or return reach of belt 44. During such return travel, finger block is held by gravity against a stop 77 on mount 64. A bump block 78 is mounted on the upper laterally outer edge of each finger mount 64 for moving the finger mount laterally inwardly and outwardly, as will be described in conjunction with FIGS. 4–8.

Each finger 68 in the preferred embodiment of the invention is of generally C-shaped integral construction as viewed longitudinally of the die system, having a laterally inwardly opening workpiece-receiving slot 79 that separates an upper section 81 from a lower section 83. A spring plunger 80 is carried on upper section 81, having a ball 88 urged by a spring 87 toward an opposed gripper 82 on lower finger section 83. Plunger 80 is adjustably mounted on section 81 so that ball 85 is normally spaced from gripper 82, as best seen in FIG. 4. The vertical dimension of slot 79, and the spacing between ball 85 and gripper 82, are such that the peripheral edge of workpiece 28 (of predetermined thickness) may be inserted (FIG. 4) between ball 85 and gripper 82 against the force of spring 87. After such insertion, workpiece 28 will be frictionally captured until forced removal (FIG. 5).

One lateral side of conveyor load station 32 is illustrated in FIG. 4, the opposing side being a mirror image thereof. A pusher 84 is mounted on frame 62 by bearings 86 for sliding motion laterally inwardly and outwardly with respect to the longitudinal dimension of the conveyor and die assembly. A first roller 88 is mounted on the laterally inner end of pusher 84 at a position to engage bumper 78 on finger mount 64 of a the hand 52 as the hand moves into position at the workpiece load station. A second roller 90 (FIGS. 1-2 and 4) is cantilevered from pusher 84 laterally outwardly of roller 88. The axis of roller 90 is oriented parallel to the conveyor direction. A pair of ramp blocks 92,94 (FIGS. 1 and 4) are mounted on a driver 96 that depends from upper die 24 at load station 32. The opposed parallel camming surfaces 93,95 of blocks 92,94 are spaced from each other to admit roller 90, and are angulated upwardly and inwardly so as to move roller 90 laterally inwardly and outwardly as a function of reciprocal motion of upper die 24.

Thus, downward motion of upper die 24 and driver 96 brings roller 90 into engagement with angulated surface 93 of block 92 to move roller 90 from the position illustrated in solid lines in FIG. 4 to that illustrated in phantom, and thus to drive finger mount 64 and finger 68 from the positions illustrated in solid lines to the positions illustrated in phantom (FIGS. 2 and 4) through abutting engagement of pusher roller 84 against block 78. Such inward motion of finger 68 drives spring plunger 80 over the opposing edge of workpiece 28, held in the plane of slot 79 by a suitable positioning fixture 97 (FIG. 4), so that the workpiece periphery is captured between plunger 80 and gripper 82. Subsequent upward motion of upper die 24 and driver 96 cams roller 90 along opposing surface 95 of ramp block 94 to move roller 90 from the position shown in solid to that shown in phantom FIG. 4, pulling pusher roller 84 laterally outwardly from block 78. However, hand 52 remains in the inward position in frictional clamping engagement with the periphery of workpiece 28. Since the same action occurs on the laterally opposing side of workpiece 28 through downward and upward motion of upper die 24, workpiece 28 is thus suspended between laterally opposing fingers 68 (FIG. 2).

FIG. 5 illustrates one lateral side of workpiece unload station 34, the opposing side again being a mirror image thereof. A pusher 98 is again laterally slidably mounted by a bearing 100 on frame 62 laterally outwardly of conveyor 40. A first roller 102 is carried at the laterally inner end of pusher 98, and a second roller 104 (FIGS. 1-2 and 5) is cantilevered from pusher 108 outwardly of roller 102 with its axis oriented longitudinally of the die assembly Roller 102 is positioned to engage block 78 on mount 64 from the inner direction (in the inner position of the mount) as hand 52 moves into position at station 31. A pair of ramp blocks 106,108 are mounted on a cam driver 110 that depends from upper die 24 at unload station 34. Blocks 106,108 have parallel surfaces 107,109 angulated upwardly and outwardly and spaced from each other to admit roller 104.

Thus, as upper die 24 descends, roller 104 is cammed by opposing surface 107 of block 106 laterally outwardly from the position shown in solid (FIGS. 2 and 5) to that illustrated in phantom (FIG. 5), pulling roller 102 outwardly against block 78 on finger mount 64, and pulling mount 64 and finger 68 laterally outwardly from the position shown in solid to that illustrated in phantom. Since the identical action takes place simultaneously on the opposing side of workpiece 28, the workpiece is released from gripping engagement with spring plunger 80 on both hands 52 at station 34, and is free to drop onto a stack or other suitable receiving device 111 (FIG. 5) for subsequent processing or storage. In the meantime, upward motion of die 24 and driver 110 moves roller 104 and pusher 98 to the positions shown in solid, while mount 64 and finger 68 remain in the laterally outwardly retracted positions shown in phantom in FIG. 5 and in solid lines in FIG. 4. In this connection, it will be noted in FIG. 3 that hands 52 return to the pickup station in the lower reach of the respective conveyors in the laterally outwardly retracted position at which rollers 74 engage and ride on guide 76.

Summarizing operation of the transfer die system to the extent thus far described, successive workpieces 28 are picked up at load station 32 upon each downward motion of upper die 24 and inward motion of opposed hands 52 at the pickup station (FIGS. 2 and 4). The respective belt conveyors are then indexed (by each upward motion of upper die 24 as will be described hereinafter), so as to bring the workpieces successively into position at die work stations 36,38. During such indexing motion, finger rollers 78 ride on guide rails 72 (FIG. 3) to support workpiece 28 above the working surfaces of lower die 22, and above the die cushion 112 associated with lower die 22 at each work station 36,38. At each work station, rail 72 is interrupted, as best seen on the right-hand side of FIG. 3. Each downward motion of upper die 24 initially brings the upper die into engagement with cushion 112 at each work station. Further downward motion lowers cushion 112, and simultaneously lowers workpiece 28 and finger 68 to the lower finger position illustrated at the right-hand side of FIG. 3 at which workpiece 28 engages the working surface of lower die 22. Further downward motion brings the upper die working surface against workpiece 28 to perform the desired forming operation.

Figure 11:
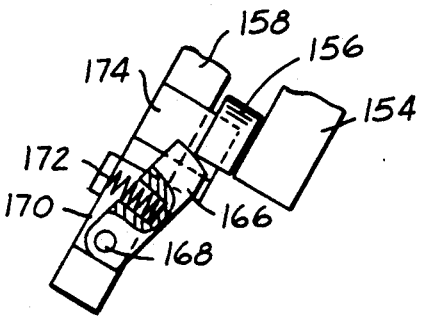
FIG. 11 is a fragmentary sectional view taken substantially along the line 11—11 in FIG. 10.

Retraction of upper die 24 in the upward direction initially allows cushion 112 to return to the upper position, returning workpiece 28 and finger 68 to the upper positions thereof illustrated at the left-hand side of FIG. 3. Further upward motion indexes the workpiece conveyor and brings rollers 78 into re-engagement with rails 72. As the workpieces reach unload station 34 (FIGS. 1-2 and 5), each downward motion of upper die 24 pulls fingers 68 laterally outwardly so as to release workpiece 28, with the fingers remaining in their laterally outward retracted positions following upward motion of the upper die and movement of pusher 98 to the position illustrated in FIG. 5. Thus, reciprocation of upper die 24 in continuous uninterrupted downward and upward motions functions not only to bring the workpieces into forming engagement with the opposing die surfaces at the work stations of the die system, but also to load and unload workpieces onto and from conveyor 26 at the upstream and downstream ends of the transfer die system. Further, as will be described hereinafter in conjunction with FIGS. 9–11, upward motion of the upper die also functions to index conveyor 26 through drive shaft 50. Thus, all motions of conveyor 26 are controlled by reciprocation of the upper die.

FIGS. 6–8 illustrate one side of a modified work station 38*a*, the laterally opposing side being a mirror image thereof, for releasing the workpiece as the upper die descends and thereafter regripping the workpiece laterally inwardly from the position at which the workpiece was released. The modification of FIG. 6–8 may be employed where the dies at the work station are to form the workpiece adjacent to the peripheral edge at which hand 68 may interfere with the die forming mechanisms. At station 38*a*, a pusher 114 is mounted by a bearing 116 on frame 62 for lateral sliding motion inwardly and outwardly with respect to the longitudinal dimension of the die assembly. A pair of rollers 118,120 are carried at the laterally inner end of pusher 114, and are laterally spaced from each other by a distance to receive pusher block 78 on finger mount 64 of each hand 52 as the hands enter work station 38*a*. A second roller 122 is mounted laterally outwardly of rollers 118,120, and has its axis oriented longitudinally of the die assembly. A pair of ramp blocks 124,126 are mounted on a driver 128 that depends from upper die 24, and have opposed upwardly and outwardly angulated parallel camming surfaces 125,127 spaced from each other so as to receive roller 122. A leaf 130 is pivotally mounted by a pin 132 in an opening 134 on driver 128 beneath ramp block 126. Leaf 130 is urged by a coil spring 136 longitudinally of driver 128 outwardly of opening 134 to a normal position at which a planer surface 138 of leaf 130 is aligned with camming surface 127 of ramp block 126, as illustrated in FIG. 6.

During descent of upper die 24 and driver 128 (FIGS. 6–8), roller 122 on pusher 114 initially engages leaf 130 and moves leaf 130 against spring 136 into opening 134 (FIG. 8). Roller 122 thus bypasses leaf 130 during such initial downward motion of the upper die, reaching the position illustrated in noted lines in FIGS. 6 and 7. Further downward motion of the upper die brings roller 22 into engagement with opposing surface 125 of ramp block 124, so that roller 122 and pusher 114 are moved laterally outwardly, or to the left in FIG. 6, to the position illustrated in phantom at 122*a*. Identical simultaneous action on the other side of the conveyor thus pulls both fingers 68 out of gripping engagement with the workpiece, so that the workpiece rests on cushion 112 (FIG. 3) and is unsupported by the laterally opposed conveyor hands. Subsequent upward motion of upper die 24 initially brings roller 122 into camming engagement with surface 127 of ramp block 126, which moves roller 122, pusher 114 and hand 52 back to the position shown in solid lines in FIG. 6. Continued upward motion of upper die 24 and driver 128 brings surface 138 of leaf 130 into engagement with roller 122, so as to move roller 122 and finger 68 laterally further inwardly to the roller position illustrated in phantom at 122*b* (FIG. 6) and to the finger position illustrated in phantom. Simultaneous action on the opposing side of the die assembly brings fingers 68 into gripping engagement with the workpiece laterally inwardly of the positions at which the workpiece was initially released.

Figure 9:
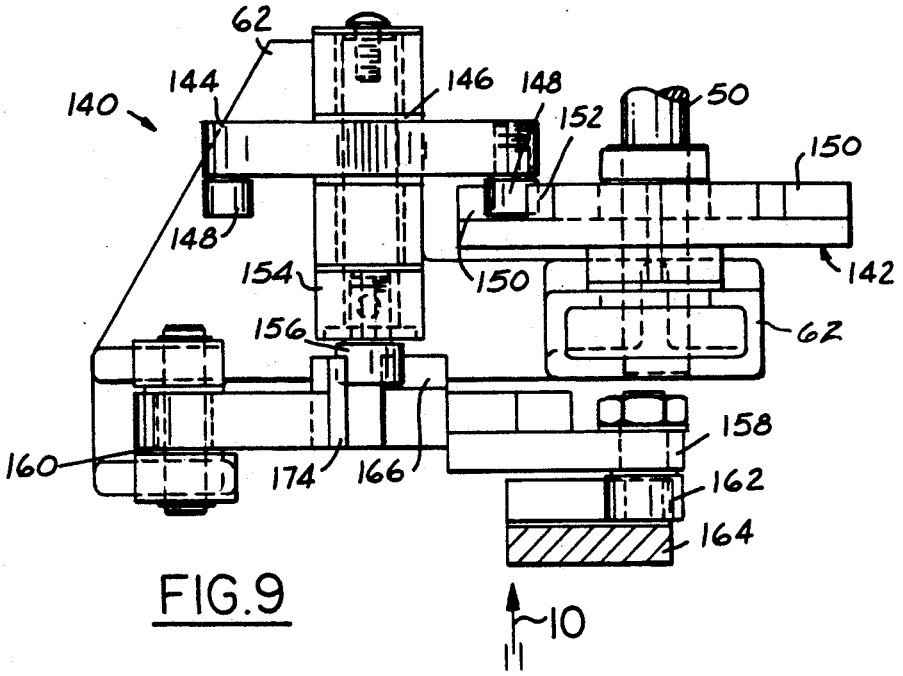
FIG. 9 is a fragmentary top plan view of the conveyor drive mechanism.
Figure 10:
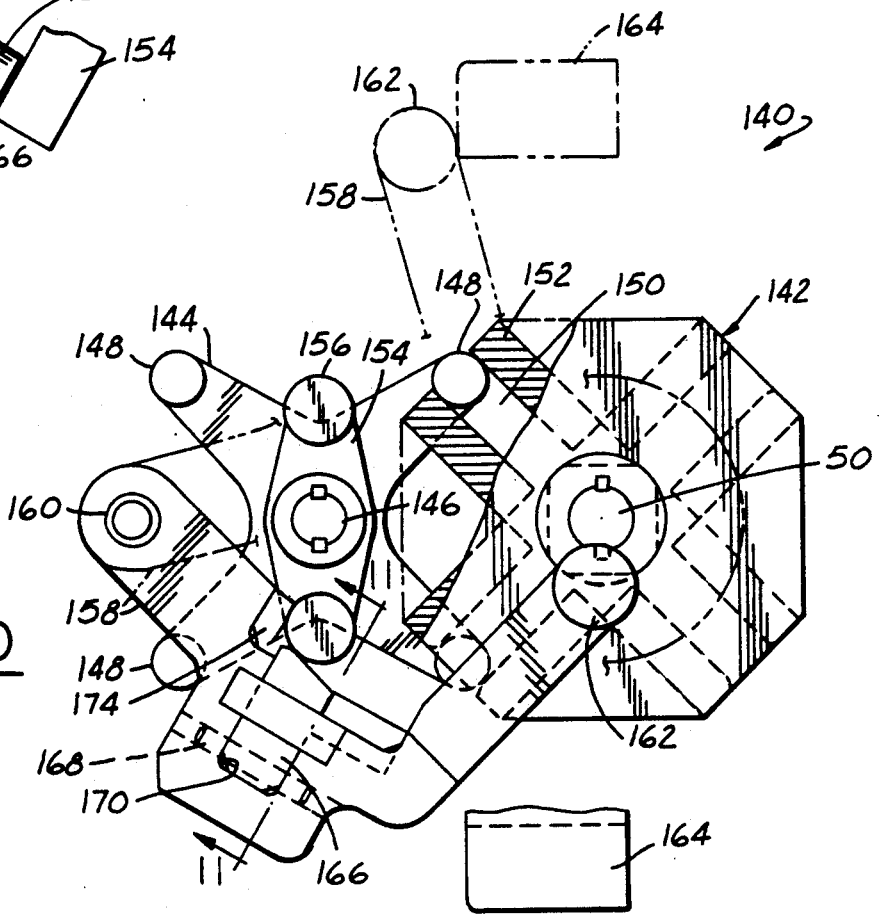
FIG. 10 is a side elevational view of the drive mechanism taken substantially from the direction 10 in FIG. 9.

FIGS. 9–10 illustrate conveyor drive 140 as comprising a geneva drive that mechanically couples conveyor drive shaft 50 (FIGS. 1–2 and 9–10) to upper die 24 for indexing conveyor 26 in equal increments upon each upward movement of the upper die. More specifically, geneva drive 140 comprises a geneva wheel 142 keyed to drive shaft 50 for corotation therewith. A star-shaped geneva drive 144 is mounted for rotation about a shaft 146 carried by conveyor frame 62 adjacent to and parallel with drive shaft 50. Rollers 148 are mounted at the ends of the four orthogonally spaced arms of drive 144 for entry into the orthogonal slots 150 of geneva wheel 142 defined by the opposed pairs of wear guides 152. A drive arm 154 is centrally keyed to shaft 146 for corotation with drive 144. A pair of rollers 156 are mounted at the diametrically opposed ends of arm 154. A drive actuator arm 158 is carried at one end for rotation on a shaft 160 that is mounted in fixed position on frame 62 parallel to and coplaner with the axes of shafts 50,146. The opposing end of arm 58 carries a roller 162 that is positioned to be engaged by a lift 164 (FIGS. 1–2 and 9–10) that depends from upper die 24. A leaf 166 is pivotally mounted by a pin 168 within an opening 170 in the central portion of arm 158, and is urged outwardly with respect thereto by a coil spring 172. A stop plate 174 extends from arm 158 toward arm 154 adjacent to leaf 166.

In operation of geneva drive 140, initial upward motion of die 24 and lift 164 results in lost motion until lift 164 engages roller 162 at the free end of arm 158. During such lost motion at the geneva drive, hands 52 regrip the workpiece (FIG. 6, if necessary) and the workpiece is lifted by cushion 112 (FIG. 3). Continued upward motion of lift 164 and the upper die pivots arm 58 around shaft 160 (counterclockwise in FIG. 10), and simultaneously rotates arm 154 around the axis of shaft 146 through abutting engagement of plate 174 and leaf 166 with the adjacent roller 156. Rotation of arm 154 and shaft 146 rotates drive 144 so as to bring the arms thereof into driving engagement with wheel 142. Such rotation of arm 154, shaft 146, drive 144 and wheel 142 continues until lift 164 reaches the fully upward position illustrated in phantom in FIG. 10, by which point arm 154, drive 144, wheel 142 and drive shaft 50 have rotated 180° clockwise (in the orientation of FIG. 10). Such 180° rotation of drive shaft 50 indexes conveyor 26 (FIG. 1) one die station position. Thereafter, on the next downward stroke of upper die 24, lift 164 descends, and arm 158 rotates at shaft 160 by force of gravity in the clockwise direction in FIG. 10. When leaf 166 engages the lower roller 156 on arm 154, leaf 166 is urged by the roller into opening 170 against the force of spring 172. When the leaf clears the roller, the leaf returns to the outer position illustrated in FIG. 11 so as to be positioned to engage the arm roller upon the subsequent upward stroke of the upper die assembly and lift 164. In this way, arm 158 bypasses the lower roller 156 on arm 154 during downward motion, and is "armed" for the next drive cycle when the upper die ascends.

Figure 12:
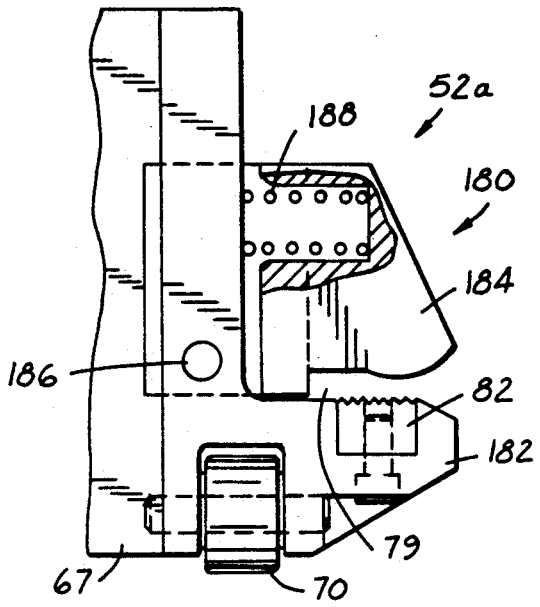
FIGS. 12–14 are fragmentary views of respective modified embodiments of the conveyor workpiece hands.
Figure 13:
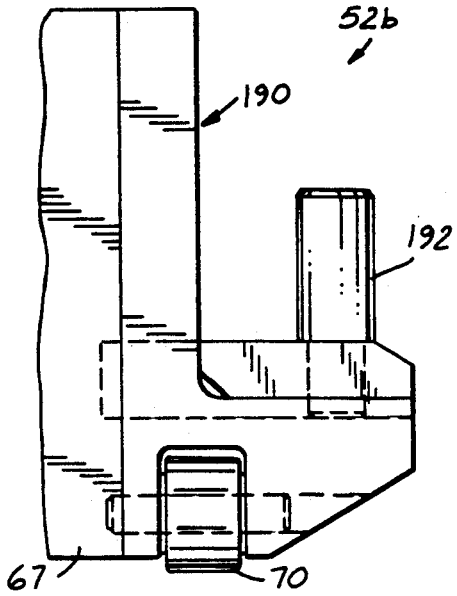
Figure 14:
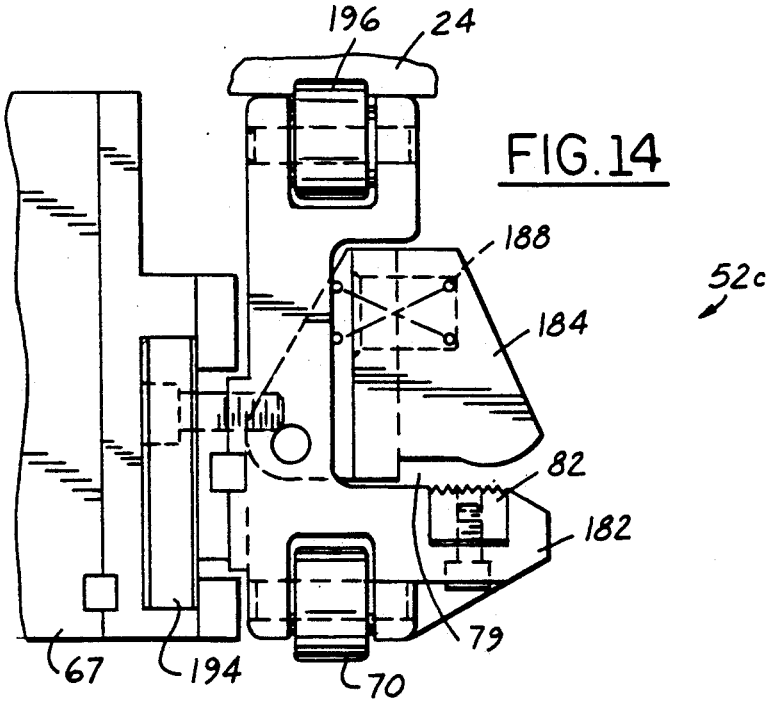

FIG. 12 illustrates a modified hand 52*a* that includes a finger 180 having a fixed lower jaw 182 that carries roller 70 and gripper 82. An upper jaw 184 is pivotally mounted by a pin 186 over lower jaw 182, and is urged toward lower jaw 182 by a coil spring 188. The lower edge of jaw 184 opposing gripper 82 is rounded or convex so as to guide the peripheral edge of a workpiece between jaw 184 and gripper 82. Finger 180 thus functions in a manner similar to that hereinabove discussed in conjunction with finger 68 FIG. 13 illustrates a second modified hand construction 52*b* in which a finger 190 carries an upwardly extending pin 192. Finger 190 is thus constructed for engaging and locating, but not positively gripping, the peripheral edge of a workpiece. FIG. 14 illustrates another hand construction 52c in which jaw 182 is coupled to block 67 by a bearing 194 that permits rotation of jaw 82 about an axis lateral to the longitudinal dimension of the die assembly. A roller 196 is carried at the upper end of jaw 182 for engaging a suitable camming surface on upper die 124 upon descent of the upper die so as to rotate jaws 182,184 about the axis of bearing 94. Hand 52c thus accommodates angular rotation of the workpiece grip for performing operations on the workpiece at an angle to the plane of the workpiece periphery gripped by the hand.

I claim:

1. A transfer die system that includes lower die means, upper die means carried for reciprocal movement toward and away from said lower die means to perform operations on workpieces positioned between said die means, and means sequentially conveying workpieces between and die means, wherein said conveying means comprises:

An endless-loop conveyor having one reach positioned between said upper and lower die means, a plurality of hands carried by said conveyor and including means for selectively engaging individual workpieces, and means for indexing said conveyor and workpieces engaged by said hands between said upper and lower die means, said upper and lower die means including means forming a plurality of stations spaced from each other lengthwise of said conveyor reach, said hands spaced from each other lengthwise of said conveyor by distances corresponding to separation between said stations such that at least one said hand engages the workpiece at each said station, said stations further including at least one work station at which said upper and lower die means include means for performing a selected operation on a workpiece positioned therebetween, and said upper die means at said workstation including means for engaging said hand for releasing the workpiece carried by said hand at said work station upon reciprocation of said upper die means toward said lower die means and re-engaging the workpiece at said work station upon reciprocation of said upper die means away from said lower die means.

2. A transfer die system that includes lower die means, upper die means carried for reciprocal movement toward and away from said lower die means for perform operations on workpieces positioned between said die means, and means for sequentially conveying workpieces between said die means, wherein said conveying means comprises:

an endless-loop conveyor having one reach positioned between said upper and lower die means, a plurality of hands carried by said conveyor and including means for selectively engaging individual workpieces, and means for indexing said conveyor and workpieces engaged by said hands between said upper and lower die means, said upper and lower die means including means forming a plurality of stations spaced from each other lengthwise of said conveyor reach, said hands being spaced from each other lengthwise of said conveyor by distances corresponding to separation between said stations such that at least one said hand engages the workpiece at each said station, said stations further including at least one work station at which said upper and lower die means includes means for performing a selected operation on a workpiece positioned therebetween, and said system at said work station including means for engaging said hand to rotate said hand about an axis at preselected orientation with respect to said conveyor while engaging and locating the workpiece at said work station.

3. A transfer die system that includes lower die means, upper die means carried for reciprocal movement toward and away from said lower die means to perform operations on workpieces positioned between said die means, and means for sequentially conveying workpieces between and die means, wherein said conveying means comprises:

a conveyor positioned between said upper and lower die means, a plurality of hands carried by said conveyor and including means for selectively engaging individual workpieces, and means for indexing said conveyor and workpieces engaged by said hands between said upper and lower die means, said upper and lower die means including means forming a plurality of stations spaced from each other lengthwise of said conveyor, said hands being spaced from each other lengthwise of said conveyor by distances corresponding to separation between said stations such that at least one hand engages the workpiece at each said station, said stations including at least one work station at which said upper and lower die means include means for performing a selected operation on a workpiece positioned therebetween, said system further including means at said work station for engaging said hand to rotate said hand about an axis at preselected orientation with respect to said conveyor while engaging and locating the workpiece at said work station.

4. The die transfer system set forth in claim 3 wherein said rotating means comprises means carried at fixed position at said work station for engaging each said hand in turn as said hands are indexed by said conveyor means through said work station.

5. The die transfer system set forth in claim 1 wherein said conveyor comprises first and second said endless conveyors on opposed lateral sides of said upper and lower die means, each said conveyor being a mirror image of the other and including laterally opposed pairs of said hands, said indexing means being coupled to both said conveyors to index said conveyors simultaneously.

6. The transfer die system set forth in claim 3 wherein each of said hands includes means for releasably gripping a peripheral edge of a workpiece.

7. The transfer die system set forth in claim 6 wherein each of said hands includes a gripping finger and means for resiliently capturing the periphery of a workpiece against said gripping finger.

8. The transfer die system set forth in claim 4 wherein said resiliently-capturing means includes a spring and means urged by said spring toward said gripping finger.

9. The transfer die system set forth in claim 7 wherein each of said hands further includes means mounting said gripping finger and said resiliently-capturing means for rotation about an axis at preselected orientation with respect to the longitudinal dimension of said die means.

10. The transfer die system set forth in claim 9 wherein said upper die means further includes means at said work station for engaging said gripping finger and rotating said finger about said axis.

11. The transfer die system set forth in claim 9 further comprising means at said work station for engaging said gripping finger and rotating said finger about said axis.

12. A transfer die system that includes lower die means, upper die means mounted for reciprocal vertical movement toward and away from said lower die means, said upper and lower die means defining a plurality of die stations spaced from each other lengthwise of said die means including workpiece load and unload stations at opposed ends of said die means and at least one work station between said load and unload stations at which said upper and lower die means include means for performing a selected operation on a workpiece positioned therebetween upon closure of said die means, and means for conveying a sequence of workpieces in turn from said load station through said work station to said unload station comprising, a pair of endless loop conveyors positioned on laterally opposed sides of said lower die means, each of said conveyors including a horizontal reach that extends coplanar with the other between said upper and lower die means lengthwise of said die means through said stations, a plurality of hands carried in opposed pairs on said conveyors, each of said hands including means for engaging and locating the periphery of a workpiece, said hands being spaced from each other lengthwise of said conveyors by a distance corresponding to separation between said stations such that at least one opposed pair of said hands engage a workpiece at each said station, said hands comprising means mounting each said hand to the associated conveyor for horizontal motion laterally inwardly of said die means, first means for engaging laterally opposed hands on said conveyors at said load station to cause said hands to engage and locate a workpiece positioned therebetween, said first means comprising means at said load station for moving laterally opposed pairs of said hands laterally inwardly simultaneously to engage lateral edges of a workpiece positioned therebetween, second means for engaging laterally opposed hands on said conveyors at said unload station to cause said hands to release a workpiece positioned therebetween, said second means comprising means at said unload station for moving laterally opposed pairs of hands laterally outwardly simultaneously to release lateral edges of a workpiece positioned therebetween, and means for indexing said conveyors and workpieces engaged and located by said hands lengthwise of said die means through said stations by incremental distance corresponding to separation between said stations.

13. The transfer die system set forth in claim 12 wherein said first means comprises first pusher means at said load station adjacent to each said conveyor at a position to laterally engage said hands, first follower means on each said first pusher means, and first means operatively coupled to said upper die means for engaging said first follower means upon reciprocation of said upper die means to urge said first pusher means and said hands engaged by said first pusher means laterally inwardly to engage the workpiece, and wherein said second means comprises second pusher means at said unload station adjacent to each said conveyor at a position to laterally engage said hands, second follower means on each said second pusher means, and second cam means operatively coupled to said upper die means for engaging said second follower means upon reciprocation of said upper die means to urge said second pusher means and said hands engaged by said second pusher means laterally outwardly to release the workpiece.

14. The transfer die system set forth in claim 12 wherein said conveyors comprise vertical loop conveyors and a single drive shaft coupled to each said conveyor, and wherein said mechanical drive means comprise geneva drive means coupled to said shaft.

15. A transfer die system that includes lower die means, upper die means mounted for reciprocal vertical movement toward and away from said lower die means, said upper and lower die means defining a plurality of die stations spaced from each other lengthwise of said die means including workpiece load and unload stations at opposed ends of said die means and at least one work station between said load and unload stations at which said upper and lower die means include means for performing a selected operation on a workpiece positioned therebetween upon closure of said die means, and means for conveying a sequence of workpieces in turn from said load station through said work station to said unload station comprising, a pair of conveyors positioned on laterally opposed sides of said lower die means, each of said conveyors extending coplanar with the other between said upper and lower die means lengthwise of said die means through said stations, a plurality of hands carried in opposed pairs on said conveyors, each of said hands including means for engaging and locating the periphery of a workpiece, said hands being spaced from each other lengthwise of said conveyors by a distance corresponding to separation between said stations such that at least one opposed pair of said hands engage a workpiece at each said station, means mounting each said hand to the associated conveyor for horizontal motion laterally inwardly of said die means, first means for engaging laterally opposed hands on said conveyors at said load station to cause said hands to engage and locate a workpiece positioned therebetween, said first means comprising means at said load station for moving laterally opposed pairs of said hands laterally inwardly simultaneously to engage lateral edges of a workpiece positioned therebetween, second means for engaging laterally opposed hands on said conveyors at said unload station to cause said hands to release a workpiece positioned therebetween, said second means comprising means at said unload station for moving laterally opposed pairs of hands laterally outwardly simultaneously to release lateral edges of a workpiece positioned therebetween, and means for indexing said conveyors and workpieces engaged and located by said hands lengthwise of said die means through said stations by incremental distance corresponding to separation between said stations, said first means comprising first pusher means at said load station adjacent to each said conveyor at a position to laterally engage said hands, first follower means on each said first pusher means, and first cam means operatively coupled to said upper die means for engaging said first follower means upon reciprocation of said upper die means to urge said first pusher means and said hands engaged by said first pusher means laterally inwardly to engage the workpiece, said second means comprising second pusher means at said unload station adjacent to each said conveyor at a position to laterally engage said hands, second follower means on each said second pusher means, and second cam means operatively coupled to said upper die means for engaging said second follower means upon reciprocation of said upper die means to urge said second pusher means and said hands engaged by said second pusher means laterally outwardly to releaser the workpiece.

16. The transfer die system set forth in claim 15 wherein each of said first and second pusher means comprises a slide carried laterally outwardly adjacent to said conveyor with means at the inner side of each said slide for engaging said hands, wherein each of said first and second follower means comprises a roller on an associated slide, and wherein each of said first and second cam means comprises ramp means on said upper die means for engaging the associated said roller means upon reciprocation of said upper die means toward said lower die means.

17. The transfer die system set forth in claim 15 wherein each of said hands includes third means affixed to the associated conveyor, fourth means mounted on said third means for motion laterally inwardly of said die means, fifth means carried by said fourth means for vertical motion toward said lower die means, and a workpiece finger carried by said fifth means for engaging the workpieces.

18. The transfer die system set forth in claim 15 further comprising third means for engaging laterally opposed hands on said conveyors at said work station to cause said hands to release the workpiece at said work station as said upper die means descends toward said lower die means and to reengage the workpiece at said work station as said upper die means ascends from said lower die means.

19. The transfer die system set forth in claim 18 wherein said third means comprises third pusher means at said work station adjacent to each said conveyor at a position to laterally engage said hands, third follower means operatively coupled to each said third pusher means, and third cam means operatively coupled to said upper die means for engaging said third follower means upon reciprocation of said upper die means to pull said third pusher means and said hand laterally outwardly as said upper die means descends and push said third follower means and said hand laterally inwardly as said upper die means ascends.

20. The transfer die system set forth in claim 19 wherein each said third pusher means comprises a slide carried outwardly adjacent to said conveyor with means at the inner end of each said slide for engaging said hands, wherein each said third follower means comprises a roller on the associated slide, and wherein each said third cam means comprises ramp means on said upper die means for engaging the associated said roller upon descent and ascent of said upper die means.

21. The transfer die system set forth in claim 11 wherein said indexing means comprises mechanical drive means operatively coupling said conveyor to said upper die means for indexing said conveyor upon each reciprocation of said upper die means.

22. The transfer die system set forth in claim 15 wherein each of said first and second pusher means comprises a slide carried laterally outwardly adjacent to said conveyor with means at the inner side of each said slide for engaging said hands, wherein said first and second follower means comprise at least one roller coupled to said slides, and wherein said first and second cam means comprise ramp means on said upper die means for engaging said at least one roller means upon reciprocation of said upper die means toward said lower die means.

23. A transfer die system that includes lower die means, upper die means mounted for reciprocal vertical movement toward and away from said lower die means, said upper and lower die means defining a plurality of die stations spaced from each other lengthwise of said die means including workpiece load and unload stations at opposed ends of said die means and at least one work station between said load and unload stations at which said upper and lower die means include means for performing a selected operation on a workpiece positioned therebetween upon closure of said die means, and means for conveying a sequence of workpieces in turn from said load station through said work station to said unload station comprising, a pair of conveyors positioned on laterally opposed sides of said lower die means, each of said conveyors extending coplanar with the other between said upper and lower die means lengthwise of said die means through said stations, a plurality of hands carried in opposed pairs on said conveyors, each of said hands including means for engaging and locating the periphery of a workpiece, said hands being spaced from each other lengthwise of said conveyors by a distance corresponding to separation between said stations such that at least one opposed pair of said hands engage a workpiece at each said station, means mounting each said hand to the associated conveyor for horizontal motion laterally inwardly of said die means, first means for engaging laterally opposed hands on said conveyors at said load station to cause said hands to engage and locate a workpiece positioned therebetween, said first means comprising means at said load station for moving laterally opposed pairs of said hands laterally inwardly simultaneously to engage lateral edges of a workpiece positioned therebetween, second means for engaging laterally opposed hands on said conveyors at said unload station to cause said hands to release a workpiece positioned therebetween, said second means comprising means at said unload station for moving laterally opposed pairs of hands laterally outwardly simultaneously to release lateral edges of a workpiece positioned therebetween, means for indexing said conveyors and workpieces engaged and located by said hands lengthwise of said die means through said stations by incremental distance corresponding to separation between said stations, and third means for engaging laterally opposed hands on said conveyors at said work station to cause said hands to release the workpiece at said work station as said upper die means descends toward said lower die means and the reengage the workpiece at said work station as said upper die means ascends from said lower die means, said third means comprising pusher means at said work station adjacent to each said conveyor at a position to laterally engage said hands, follower means operatively coupled to each said pusher means, and cam means operatively coupled to said upper die means for engaging said follower means upon reciprocation of said upper die means to pull said pusher means and said hand laterally outwardly as said upper die means descends and push said follower means and said hand laterally inwardly as said upper die means ascends, each said pusher means comprising a slide carried outwardly adjacent to said conveyor with means at the inner end of each said slide for engaging said hands, each said follower means comprising a roller on the associated slide, and each said cam means comprising ramp means on said upper die means for engaging the associated said roller upon descent and ascent of said upper die means.

24. The transfer die system set forth in claim 23 wherein each said third ramp means further includes means for bypassing the associated said roller upon descent of said upper die means and engaging the said roller upon ascent of said upper die means for moving said hand laterally inwardly upon ascent of said upper die means a distance greater than that moved laterally outwardly upon descent of said upper die means.

25. The transfer die system set forth in claim 24 wherein each said ramp means includes a fixed upper ramp segment for engaging the associated said roller during descent of said upper die means, a fixed lower ramp segment for engaging the roller during initial ascent of said upper die means, and a spring-biased leaf at the lower end of said fixed lower ramp segment said leaf having a first surface for engaging the roller to urge said leaf against said spring bias during descent of upper die means to bypass the roller and a second surface for engaging the roller upon ascent of said upper die means effectively to extend said lower ramp segment.

26. A transfer die system that includes lower die means, upper die means mounted for reciprocal vertical movement toward and away from said lower die means, said upper and lower die means defining a plurality of die stations spaced from each other lengthwise of said die means including workpiece load and unload stations at opposed ends of said die means and at least one work station between said load and unload stations at which said upper and lower die means include means for performing a selected operation on a workpiece positioned therebetween upon closure of said die means, and means for conveying a sequence of workpieces in turn from said load station through said work station to said unload station comprising, a pair of conveyors positioned on laterally opposed sides of said lower die means, each of said conveyors extending coplaner with the other between said upper and lower die means lengthwise of said die means through said stations, a plurality of hands carried in opposed pairs on said conveyors, each of said hands including means for engaging and locating the periphery of a workpiece, said hands being spaced from each other lengthwise of said conveyors by a distance corresponding to separation between said stations such that at least one opposed pair of said hands engage a workpiece at each said station, means mounting each said hand to the associated conveyor for horizontal motion laterally inwardly of said die means, first means for engaging laterally opposed hands on said conveyors at said load station to cause said hands to engage and locate a workpiece positioned therebetween, said first means comprising means at said load station for moving laterally opposed pairs of said hands laterally inwardly simultaneously to engage lateral edges of a workpiece positioned therebetween, second means for engaging laterally opposed hands on said conveyors at said unload station to cause said hands to release a workpiece positioned therebetween, said second means comprising means at said unload station for moving laterally opposed pairs of hands laterally outwardly simultaneously to release lateral edges of a workpiece positioned therebetween, and means for indexing said conveyors and workpieces engaged and located by said hands lengthwise of said die means through said stations by incremental distances corresponding to separation between said stations, said indexing means comprising mechanical drive means operatively coupling said conveyor to said upper die means for indexing said conveyor upon each reciprocation of said upper die means, said conveyors comprising vertical loop conveyors and a single drive shaft coupled to each said conveyor, and said mechanical drive means comprising geneva drive means coupled to said shaft.

27. The transfer die system set forth in claim 26 wherein said geneva drive means comprises a geneva wheel coupled to said shaft, a geneva drive coupled to said wheel and mounted to rotate about a fixed axis parallel to said shaft, and means coupled to said upper die means adjacent to said geneva drive for rotating said geneva drive equal angular increments upon each reciprocation of said upper die means.

28. The transfer die system set forth, in claim 27 wherein said drive-rotating means comprises a drive arm rotatably mounted at one end adjacent to said geneva drive, a lift arm depending from said upper die means to engage the other end of said arm and to rotate said arm about said first end upon ascent of said upper die means, and means for coupling rotation of said drive arm to rotation of said geneva drive.

29. The transfer die system set forth in claim 28 wherein said coupling means comprises a second arm coupled to said geneva drive for corotation therewith, said second arm having diametrically opposed ends with bearing means at each said end, said drive arm including means for engaging a said bearing means upon upward rotation of said drive arm to rotate said second arm and said geneva drive 180° upon each ascent of said upper die means, and means for bypassing said bearing means upon descent of said upper die assembly, lift arm and drive arm.

30. A transfer die system that includes lower die means, upper die means carried for reciprocal movement toward and away from said lower die means to perform operations on workpieces positioned between said die means, and means for sequentially conveying workpieces between and die means, wherein said conveying means comprising:

a conveyor positioned between said upper and lower die means, a plurality of hands carried by said conveyor and including means for selectively engaging individual workpieces, and means for indexing said conveyor and workpieces engaged by said hands between said upper and lower die means, said upper and lower die means including means forming a plurality of stations spaced from each other lengthwise of said conveyor, and said hands being spaced from each other lengthwise of said conveyor by distances corresponding to separation between said stations such that at least one said hand engages the workpiece at each said station, said stations including workpiece load and unload stations at opposed ends of said conveyor, said hands including means for selectively positively gripping and releasing a workpiece, said system further including first means positioned at said load station and responsive to motion of said upper die means toward said lower die means for engaging and driving a hand at said load station into positive gripping engagement with a workpiece at said load station, and second means positioned at said unload station and responsive to motion of said upper die means toward said lower die means for engaging and moving a hand at said unload station to release a workpiece at said unload station, said stations further including at least one work station at which said upper and lower die means include means for performing a selected operation on a workpiece positioned therebetween, said system including means at said work station for engaging said hand to rotate said hand about an axis at preselected orientation with respect to said conveyor while engaging and locating the workpiece at said work station.

31. A transfer die system that includes lower die means, upper die means carried for reciprocal movement toward and away from said lower die means to perform operations on workpieces positioned between said die means, and means for sequentially conveying workpieces between said die means, wherein said conveying means comprises:

a conveyor positioned between said upper and lower die means, a plurality of hands carried by said conveyor and including means for selectively engaging individual workpieces, and means for indexing said conveyor and workpieces engaged by said hands between said upper and lower die means, said upper and lower die means including means forming a plurality of stations spaced from each other lengthwise of said conveyor, and said hands being spaced from each other lengthwise of said conveyor by distances corresponding to separation between said stations such that at least one said hand engages the workpiece at each said station, said stations including workpiece load and unload stations at opposed ends of said conveyor, said hands including means for selectively positively gripping and releasing a workpiece, said system further including first means positioned at said load station and responsive to motion of said upper die means toward said lower die means for engaging and driving a hand at said load station into positive gripping engagement with a workpiece at said load station, and second means positioned at said unload station and responsive to motion of said upper die means toward said lower die means for engaging and moving a hand at said unload station to release a workpiece at said unload station, said conveyor comprising first and second endless conveyors on opposed lateral sides of said upper and lower die means, each said conveyor being a mirror image of the other and including laterally opposed pairs of said hands, said indexing means being coupled to both said conveyors to index said conveyors simultaneously.

32. The die transfer system set forth in claim 31 wherein said stations further include at least one work station at which said upper and lower die means include means for performing a selected operation on a workpiece positioned therebetween, and wherein said upper die means at said work station includes means for engaging said hand for releasing the workpiece carried by said hand at said work station upon reciprocation of said upper die means toward said lower die means and reengaging the workpiece at said work station upon reciprocation of said upper die means away from said lower die means.

33. The die transfer system set forth in claim 31 wherein said station further include at least one work station at which said upper and lower die means include means for performing a selected operation on a workpiece positioned therebetween, and wherein said system at said station includes means for engaging said hand to rotate said hand about an axis at preselected orientation with respect to said conveyor while engaging and locating the workpiece at said work station.

34. The die transfer system set forth in claim 31 wherein said indexing means comprises mechanical drive means operatively coupling said conveyor to said upper die means for indexing said conveyor upon each reciprocation of said upper die means.

35. The die transfer system set forth in claim 34 wherein said mechanical drive means comprises geneva drive means including a geneva wheel coupled to said conveyor, a geneva drive disposed to rotate about a fixed axis adjacent to said geneva wheel, and means carried by said upper die means adjacent to said geneva drive for rotating said geneva drive equal angular increments upon each reciprocation of said upper die means.

* * * * *